United States Patent [19]

Stobb

[11] Patent Number: 4,650,174

[45] Date of Patent: Mar. 17, 1987

[54] METHOD AND SYSTEM FOR ROUTING A SIGNATURE FOR STITCHING

[75] Inventor: Walter J. Stobb, Pittstown, N.J.

[73] Assignee: Stobb Inc., Clinton, N.J.

[21] Appl. No.: 586,392

[22] Filed: Mar. 5, 1984

Related U.S. Application Data

[62] Division of Ser. No. 398,980, Jul. 16, 1982, Pat. No. 4,478,398.

[51] Int. Cl.[4] ..... B42B 1/02

[52] U.S. Cl. ..... 270/53; 198/617; 198/644; 227/99

[58] Field of Search ..... 270/53–54, 270/37–38; 227/150, 155, 99–103, 144, 154; 198/617, 644

[56] References Cited

U.S. PATENT DOCUMENTS

| | | | |
|---|---|---|---|
| 2,692,136 | 10/1954 | Schramm | 270/53 |
| 2,717,383 | 9/1955 | Stobb | 270/53 |
| 3,057,620 | 10/1962 | McLain | 270/53 |
| 3,245,679 | 4/1966 | Mueller | 270/53 |
| 3,536,318 | 10/1970 | Gay et al. | 270/53 |
| 3,554,531 | 1/1971 | Heigl | 270/53 |
| 3,752,468 | 8/1973 | Hart et al. | 270/53 |
| 4,041,883 | 8/1977 | Meratti et al. | 270/53 |
| 4,116,750 | 9/1978 | Lewis et al. | 270/53 |
| 4,196,835 | 4/1980 | Schlough | 227/99 |
| 4,236,706 | 12/1980 | Schlough | 270/53 |

*Primary Examiner*—E. H. Eickholt

*Attorney, Agent, or Firm*—Arthur J. Hansmann

[57] ABSTRACT

A method and system of routing a signature or stitching, and including taking folded signatures from a raceway and onto support bars or fingers and moving the signatures to a rotary stitcher where they are stitched and then removing them from the bars or fingers to a collection conveyor, all in a high-speed continuous action.

3 Claims, 2 Drawing Figures

METHOD AND SYSTEM FOR ROUTING A SIGNATURE FOR STITCHING

This is a division of U.S. patent application Ser. No. 398,980, now U.S. Pat. No. 4,478,378 filed 16 July 1982, entitled "METHOD AND SYSTEM FOR ROUTING A SIGNATURE FOR STITCHING".

This invention relates to a method and system for routing a signature for stitching, and, more particularly, it relates to a method and system whereby signatures are continuously moved from a raceway and to a stitcher and finally to a collection conveyor.

BACKGROUND OF THE INVENTION

The basic concept of this invention is in both method and apparatus which moves folded sheets along a raceway and to a lift finger or the like which transports the sheets to a rotary stapler, and finally the sheets are deposited on a conveyor. The concept permits a continuous and high-speed movement of the sheets, and it permits the use of a rotary stitcher which can be run at 60,000–70,000 signatures per hour, while other types of stitchers, such as the in-line-head type run at the slower speed of 15,000–20,000 per hour.

Accordingly, it is an object of this invention to provide a method and system or apparatus for handling folded signatures in a continuous and high-speed action while stapling or stitching the signatures together and finally depositing them on a collection conveyor. Further, the present invention accomplishes the aforementioned objectives with inexpensive and thereby a minimum of equipment which is accordingly reliable and easily installed and operated and which is compatible with existing equipment of raceways bringing the signatures to the apparatus, as well as conventional conveyors taking the signatures away from the apparatus. In this regard, a conventional type of rotary stitcher can be utilized, such as a type shown in U.S. Pat. No. 2,717,383 which is a rotary and right-angle stitcher for sheets formed into a signature in a conventional arrangement.

DETAILED DESCRIPTION OF THE PREFERRED METHOD AND EMBODIMENT

In this description, the apparatus is referred to and the method is inherently disclosed and described in reference to the apparatus. Accordingly, a conventional type of signature raceway 10 supports folded sheets, in the form of signatures 11, which are draped over the raceway 10 and are moved there along by means of the usual projections or pushers 12 which move in the direction of the arrow A. Thus the draped and folded signatures 11 are moved to the right, as viewed in FIG. 1, and a raceway-type of chain 13 can be employed for moving the signatures in the direction of the arrow A. That is conventional and will therefore be readily understood by anyone skilled in the art.

Figure 1:
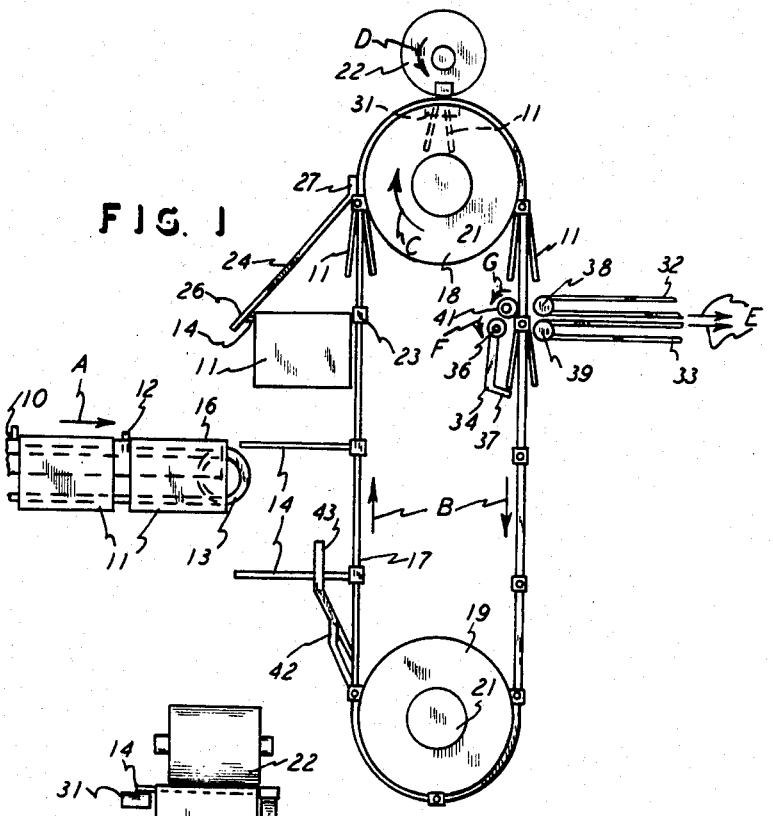
FIG. 1 is a side elevational view of apparatus showing this invention.

The signatures 11 are moved onto lift fingers 14 which, when they are in the position on the left as shown in FIG. 1 they point toward the raceway and align therewith so that the signature fold at 16 can be positioned directly on the aligned finger 14. The fingers 14 are suitably affixed to an endless chain or support 17 which moves in the direction of the arrow designated B, and thus the signature 11 is picked up by the finger 14 and moved upwardly as viewed in FIG. 1. The support 17 is suitably trained over spaced-apart cylindrical rotating members 18 and 19 which rotate in the direction of the arrow designated C on the member 18, and thus the chain or support 17 moves in the direction of the arrows B shown adjacent the support 17 which is sufficiently flexible to be trained on the circular members 18 and 19 which are on support axles 21.

Figure 2:
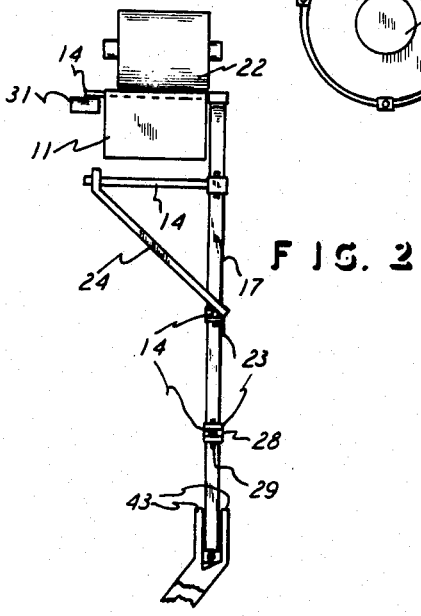
FIG. 2 is a left-side elevational view of FIG. 1.

FIG. 1 shows one signature 11 on one of the fingers 14, and that signature 11 had been pushed by the pusher 12 onto the finger 14 which was previously aligned with the raceway 10 while the support 17 was moving upwardly past the raceway 10 and the finger 14 was level with and aligned with the raceway 10. The signature 11 is therefore elevated and moved upwardly towards a rotary stitcher 22 which rotates in the direction of the arrow designated D. Between the position of the signature 11 and the stitcher 22, the signature 11 and its support finger 14 are swung 90 degrees from the position of its full line side view in FIG. 1 to the position of its dotted line end view at the upper portion of FIG. 1 and immediately below the stitcher 22. To accomplish this, the finger 14 is suitably mounted on a connector 23 affixed to the support 17 such that the fingers 14 can be swung or pivotted through the 90 degree arc mentioned. To induce the pivot, a guide or shoe 24 extends from its lower end 26 in the path of movement of the outer end of the finger 14 to its upper end 27 where it still is in contact with the outer end of the finger 14 and has thus swung the finger 14 and its supported signature 11 through the 90 degree arc, as shown. FIG. 2 also shows the arrangement and positioning of the shoe 24 relative to the two positions of the finger 14.

Thus in any suitable mechanical arrangement, the connectors 23 mounted on the support 17 are arranged to support the fingers 14 outwardly from the support 17 and permit the fingers 14 to swing through the 90 degree arc described. Such arrangement could simply be a slot 28 extending in the support block 23, and the inner end of the finger 14 could be on a vertical pin 29 in the block 23 for permitting swinging of the finger 14 through the slot 28 and the 90 degree arc mentioned.

Thus, the signatures 11 are continuously picked up from the raceway 10 and are moved in the vertical direction and then in a horizontal direction at which time they move under the rotary stitcher 22 and the fold of the signature 11 is thus presented to the stitcher 22 for the usual function of stitching the sheets of the signature together, in a then conventional stitching manner known by those skilled in the art. Also, a lower support or anvil 31 is disposed below the stitcher 22 and below the end of the finger 14 to engage the finger 14 and thus upwardly support the finger 14 during the stitching process as the finger 14 slides over the anvil 31 in the continuous movement described herein and when the signature is being stitched. Again, FIG. 2 shows the signature 11 in its uppermost position immediately below and subject to the rotary stitcher 22, and the finger 14 is shown resting on the support shoe 31, as mentioned.

Upon further continuous movement of the endless support 17, the signature 11 is moved to the right side, as viewed in FIG. 1, and it is then presented to the collecting conveyors 32 and 33 which move in the direction of the arrows E. An engager 34 is mounted adjacent the support 17 and on a pivot pin 36 and it can pivot in the direction of the arrow F and thus the engager end 37 encounters the lower edge of the signature 11 and moves the signature 11 upwardly and to the right, as viewed in FIG. 1 and thus presents the signature 11 to the inner ends or nips 38 and 39, respectively, of the conveyors 32 and 33. Thus the signatures 11 are placed onto the conveyor 33 and moved in the direction of the arrows E. Also, a rotary guide 41 is mounted adjacent the engager 34 and is available for engaging the signature 11 when the signature has been lifted from the finger 11 adjacent the conveyors 32 and 33, and the member 41 rotates in the direction of the arrow G and assists in directing the signature 11 onto the conveyor 33, due to the direction of rotation of the rotary member 41.

The then empty fingers 14 move downwardly on the right, as viewed in FIG. 1, and along the conveyor or support 17, and they move to a stationary guide or shoe 42, which, like the stationary guide or shoe 24, engages the fingers 14 and causes the fingers 14 to swing through the 90 degree arc, but now in the opposite direction so that the fingers 14 come back to their extended position leftward, as viewed in FIG. 1. Thus the fingers 14 can slide into the bifurcated guide 42 which is angulated to extend from the offset position of the fingers 14 at the lower end of the support 17 and to the in-lined position of the fingers 14 on the left of the support 17 in FIG. 1, as shown between FIGS. 1 and 2. In that manner and with that apparatus, the fingers 14 are guided by the shoe 42 back to the extended position toward the raceway 10 so that each finger 14 is ready to pick up another signature 11 and repeat the process. FIG. 2 shows the bifurcated end 43 of the guide or shoe 42 which traps the finger 14 and thus moves it through the 90 degree arc just described.

Accordingly, the method and apparatus involves a system for routing a signature for stitching, and the signature folded sheets are draped downwardly on the raceway to where they are picked up by the lift fingers 14 which are disposed adjacent the terminal end 13 of the raceway 10. The rotary stitcher 22 is located in the path of the horizontal movement of the fingers 14 and their draped signatures 11, and the signatures therefore are stitched at that point, and finally the engager 34 is disposed in the path of movement of the signature after it has been stitched so that the signature is therefore removed and placed onto the conveyor 33, all in a high-speed and continuous movement. The support 18 and/or the support 19 is considered to be a driver for the support member or belt 17 so that the apparatus moves at the one continuous high-speed described. The endless conveyor 17 is disposed in a vertical plane and it supports the fingers 14 in the horizontal direction, first toward the raceway 10 and then away from the raceway 10 and into the rotary stitcher 11 by the swinging action of the finger 14 as induced by the stationary shoe 24 over which the end of the finger 14 will slide. Finally, the engager end 37 moves in the direction opposite to the direction of movement of the support 17 therepast, and thus the signature 11 is lifted off the finger 14 and removed therefrom and past to the collection conveyors 32 and 33.

What is claimed is:

1. A method of routing a signature for stitching, comprising the steps of moving the signature in a horizontal direction and with the folded sheets thereof draped downwardly, inserting a lift finger between the folded sheets and engaging the fold of the signature and lifting the signature and moving the signature horizontally and into a stitcher, applying a stitch to the signature to secure its sheets together, and removing the stitched signature off the lift finger and placing it onto a conveyor.

2. The method of routing a signature for stitching, as claimed in claim 1, including moving the lift finger and signature thereon first upwardly, then horizontally into the stitcher, then downwardly onto the conveyor.

3. The method of routing a signature for stitching, as claimed in claim 1 or 2, wherein the signature is moved at one continuous speed while on the lift finger.

* * * * *